United States Patent [19]

Suzuki et al.

[11] 3,977,666

[45] Aug. 31, 1976

[54] APPARATUS FOR SELECTIVELY FEEDING SHEETS FROM A PLURALITY OF CASSETTES

[75] Inventors: Shigeru Suzuki, Yokohama; Kyoji Omi; Tatsuo Tani, formerly Nishikawa, both of Tokyo, all of Japan

[73] Assignee: Ricoh Co., Ltd., Japan

[22] Filed: May 16, 1975

[21] Appl. No.: 578,264

[30] Foreign Application Priority Data

May 18, 1974 Japan ..... 49-55973

[52] U.S. Cl. ..... 271/9; 271/111; 271/127; 271/160; 271/164; 271/170; 271/171

[51] Int. Cl.² ..... B65H 1/12; B65H 3/44

[58] Field of Search ..... 271/9, 111, 117, 118, 271/126, 127, 157, 160, 162, 164, 170, 171; 221/125, 126, 130

[56] References Cited

UNITED STATES PATENTS 3,563,535 2/1971 Vitu et al. ..... 271/157

3,907,283 9/1975 Miller ..... 271/164 X

FOREIGN PATENTS OR APPLICATIONS 325,880 4/1935 Italy ..... 271/127

1,167,881 10/1969 United Kingdom ..... 271/9

*Primary Examiner*—John J. Love

*Assistant Examiner*—Bruce H. Stoner, Jr.

*Attorney, Agent, or Firm*—McGlew and Tuttle

[57] ABSTRACT

An apparatus for selectively feeding desired sheets from a plurality of cassettes which store different respective sizes and kinds of sheets includes a handle lever located adjacent to the plurality of cassettes which are disposed in a vertically aligned stack. When the handle lever is moved to the location of a particular cassette containing desired sheets, only that cassette is rendered ready for feeding the sheets. If that cassette is exhausted, an indicator lamp provides a signal for sheet loading.

8 Claims, 11 Drawing Figures

APPARATUS FOR SELECTIVELY FEEDING SHEETS FROM A PLURALITY OF CASSETTES

BACKGROUND OF THE INVENTION

The invention relates to an apparatus for selectively feeding desired sheets from a plurality of cassettes which contain sheets of different respective sizes and/or kinds which may be used in a duplicating machine.

Photosensitive papers used in duplicating machines are in a variety of sizes because of the need to choose the sheet size in accordance with the size of an original to be duplicated. The only standard existing among various sheet sizes is that of half-size series, which still include varying aspect ratios. When it is desired to change the size of the copy papers in a duplicating machine, the cassette which contains them must be interchanged.

Recently, a type of cassette has been proposed which can be used in common for all those copy sheets which have an equal dimension on a side thereof, and which incorporates a detachable partition mounted in the sheet receiving portion of the cassette. Even with this cassette, a change of the sheet size requires an interruption of the duplicating operation in order to disengage and engage the partition, preventing an immediate change.

SUMMARY OF THE INVENTION

In view of the foregoing, the invention is directed to eliminating the above-mentioned inconvenience. In accordance with the invention, a plurality of sheet cassettes which store copy sheets of different respective sizes are mounted in a duplicating machine, and a handle lever cooperates with the cassettes to selectively feed copy sheets of a desired size from a particular cassette. The movement of the handle lever is utilized to provide a useful indication.

A sheet delivery is generally performed in two schemes. In a first scheme, the sheets remain stationary in a cassette while rollers engaging the periphery of the uppermost sheet are lowered or raised depending on the thickness of the sheet stack. In a second scheme, the feed rollers are stationary in position while the sheet receiving tray or plate is moved vertically. For the convenience of carrying out the invention, the second scheme is preferred because of the reduced height which is necessary for the installation of individual cassettes and because of the simplicity of the involved mechanism. As regards the drive to the feed rollers, it is most simple to employ an electrical energization of a selected clutch each of which is associated with a respective set of rollers operating with a respective cassette. However, this results in an increased cost. In accordance with the invention, the vertical movement of the sheet receiving plate is utilized to control the selective engagement and disengagement of the feed rollers in a mechanical manner.

DETAILED DESCRIPTION OF AN EMBODIMENT

The invention will now be described with reference to the drawings which show a duplicating machine in which a pair of cassettes are mounted. In the description to follow, terms relating to directions are referenced to the duplicating and cassettes. Specifically, the direction into which a cassette is inserted into the machine is referred to as "forward" and is indicated by an arrow labelled F in FIG. 3. All other directions including rearward, upper, lower, left-hand and right-hand directions are based on this choice of the forward direction. Also, a rotating member will be referred as rotating in the CW or CCW direction when it rotates in the clockwise or counterclockwise direction.

Figure 1:
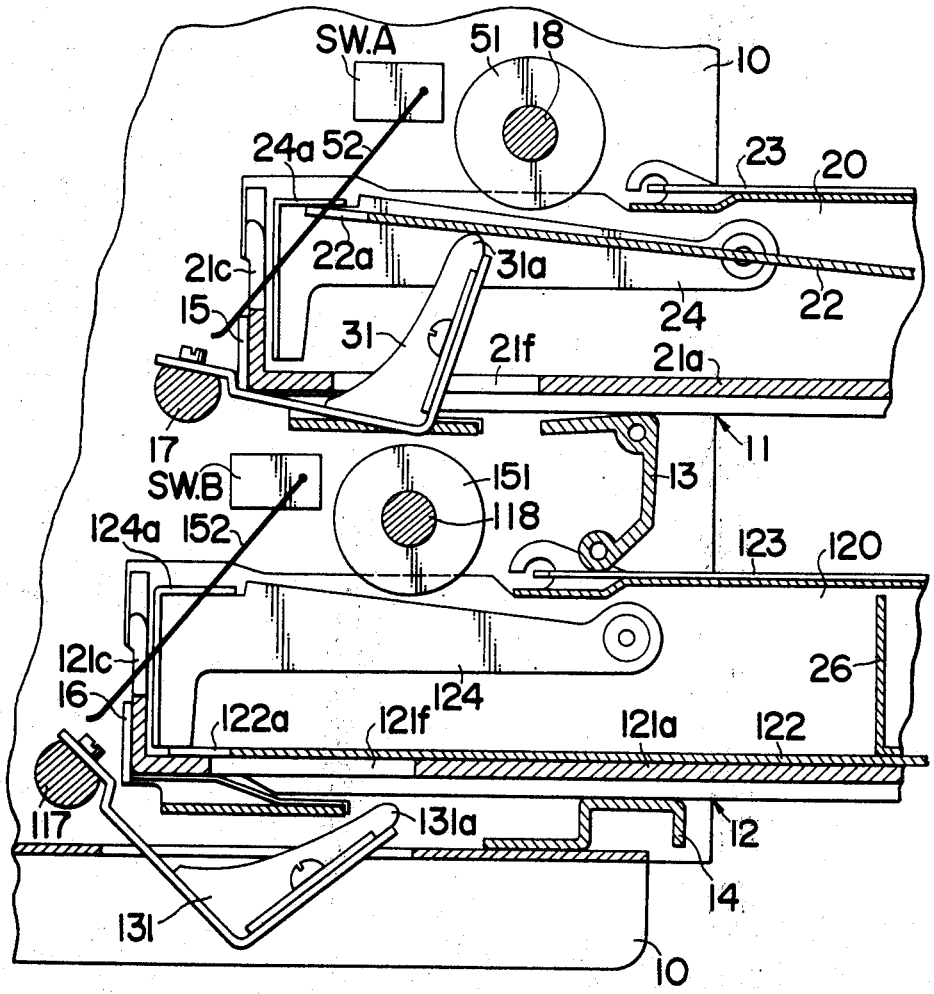
FIG. 1 is an elevational section of a pair of cassette cases constructed in accordance with one embodiment of the invention.

Referring to FIG. 1, there is shown a rear portion of a duplicating machine 10 having a pair of cassette cases 11, 12 which open to the rear of the machine. A pair of cassettes 20, 120 are inserted into the cases 11, 12, respectively, and their bottoms rest on a gate member 13 and a channel member 14, respectively. At their forward ends the cassettes bear against respective abutments 15, 16 when completely loaded.

Figure 2:
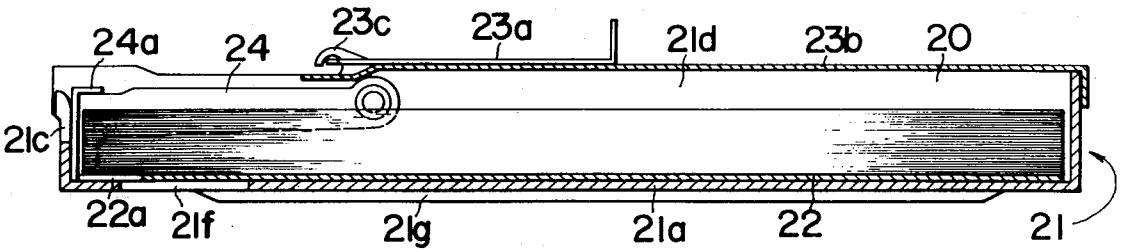
FIG. 2 is a vertical section of a cassette shown in FIG. 1.
Figure 3:
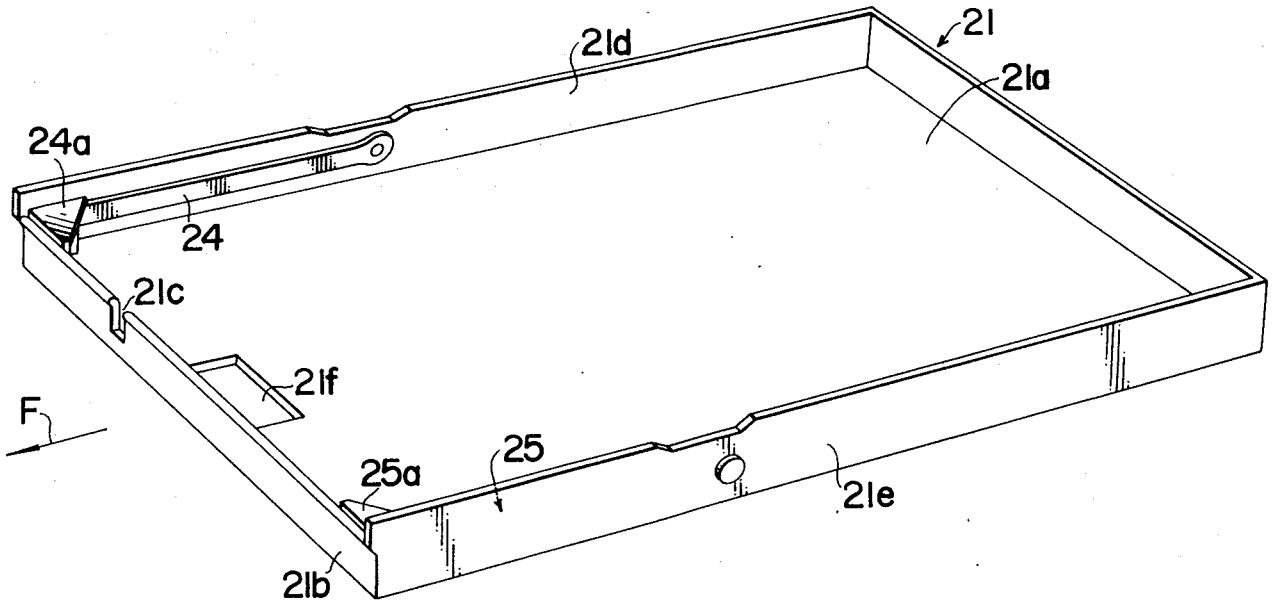
FIG. 3 is a perspective view of the body of the cassette.
Figure 5:
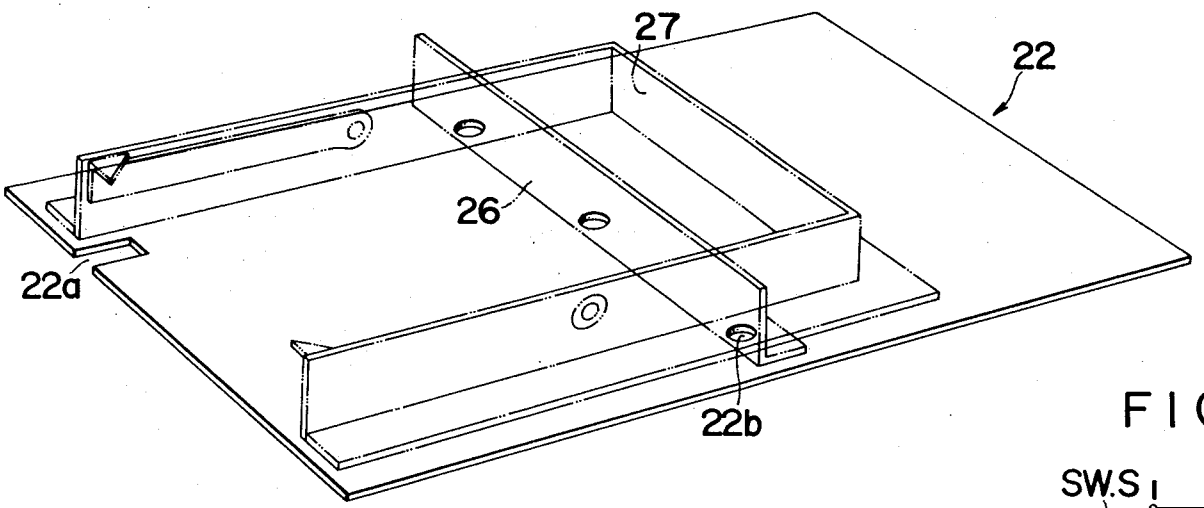
FIG. 5 is a perspective view of a sheet receiving plate.

Referring to FIGS. 2, 3, and 5, and the construction of each cassette will be described first. However, it should be understood that the cassette 120 received in the lower case 12 is similar to the cassette 20 in the upper case 11 except for the provision of a partition 26 to be described later, and therefore will not be specifically described. Nevertheless the construction and operation of the cassette 120 will be entirely clear from the description of the cassette 20 since counter-parts of the cassette 120 which correspond to the described parts of the cassette 20 are designated by like numerals increased by 100.

The cassette 20 comprises a body 21 (FIG. 3) in the form of a top-open thin box, a sheet receiving plate 22 (FIG. 5) resting on the bottom plate 21*a* of the body, and a lid 23 (FIG. 4) which covers the top of the body 21. More specifically, the body 21 includes a front wall 21*b* which extends one-half the depth of the box-shaped body from the bottom so as to provide a sheet passage thereabove, In addition, the front wall 21*b* is formed with a notch 21*c* toward its right-hand side in order to provide clearance for a switch actuating arm as will be further described later. Along the inner surface of the forward one-half of right- and left-hand side walls 21*d*, 21*e*, there are disposed respective corner separators 24, 25 which are pivotally mounted on the side walls at their one ends nearer the central portion of the side walls. The free end of each corner separator is bent so as to extend along the inner surface of the front wall 21*b* with its bend forming a triangular pad 24*a*, 25*a* which bears against the respective forward corner of a sheet stack under the influence of gravity of the separator. In its forward end, the bottom plate 21*a* is centrally formed with a notch 21*f* which provides clearance for an actuating arm for pushers of the duplicating machine, to be described later. Finally, the bottom plate 21*a* is formed on its lower surface with a lengthwise extending rib 21*g* for sliding contact with a support provided on the duplicating machine.

Figure 4:
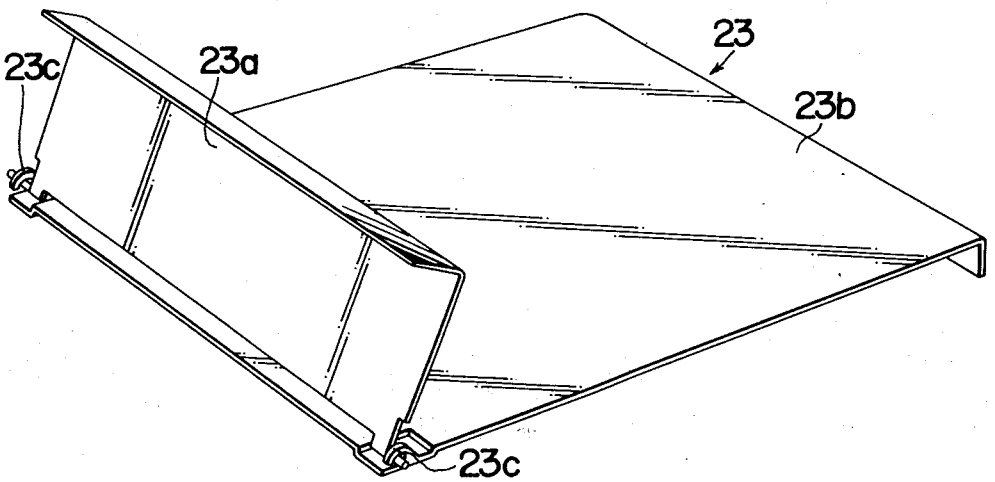
FIG. 4 is a perspective view of the lid of the cassette.

The lid 23 comprises a pair of forward and rearward portions 23*a*, 23*b* which are hinged together at 23*c* so as to cover and uncover the forward portion of the cassette 20. Before the cassette is inserted into the machine, the forward portion 23*a* is turned over the rearward portion 23*b*, as shown in FIG. 4.

In its forward end toward the right-hand side, the sheet receiving plate 22 is formed with a notch 22*a* which provides clearance for a switch actuating arm to be described later. The plate 122 of the cassette 120 is formed with spaced apertures 22*b* for receiving tabs extending from the partition 26. The sheet receiving plate 22 has an inside means which corresponds to B-series No. 4 of Japanese Industrial Standard. The partition 26, shown in phantom lines in FIG. 5, which is used to form the cassette 120, is channel-shaped in overall configuration and L-shaped in cross section and has a length which is essentially equal to the width of the plate 122. As will be apparent, the cassette 20 is suitable for receiving copy sheets having a B4 size while the cassette 120 is suitable for receiving copy sheets having a B5 size.

The arrangement in the duplicating machine 10 will be more fully described with reference to FIGS. 1, 6*a* and 6*b*. Referring to FIG. 1 initially, a horizontally extending rotary shaft 17 is rotatably journaled on a stationary member at a position forwardly of and very close to the lower end of the upper abutment 15. Secured to the shaft 17 is an actuating arm 31 for pushers to be described later, and when driven by shaft 17, the arm undergoes a rocking motion. The arm 31 has an upwardly extending tip 31*a* which, during a rocking motion of the arm in the CCW direction, extends into the notch 21*f* in the bottom plate of the cassette to abut against the lower surface of the sheet receiving plate 22, thereby raising its forward region.

A horizontally extending rotary shaft 18 is rotatably journaled on a stationary member at a position very close to the top of the upper cassette 20 and adjacent to the forward end thereof. A paper or sheet feed roller 51 is fixedly mounted on the shaft 18 centrally lengthwise thereof, and has the bottom of its peripheral surface positioned to bear against the sheet receiving plate 22 when the latter is raised, so that any sheet resting thereon can be fed forwardly by the action of the roller 51 frictionally engaging the uppermost sheet in the stack.

Figure 7A:
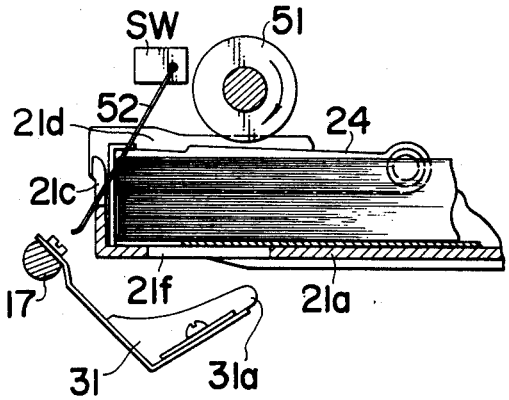
FIGS. 7*a*, 7*b*, and 7*c* are schematic illustrations of feed rollers cooperating with an uppermost sheet.
Figure 7B:
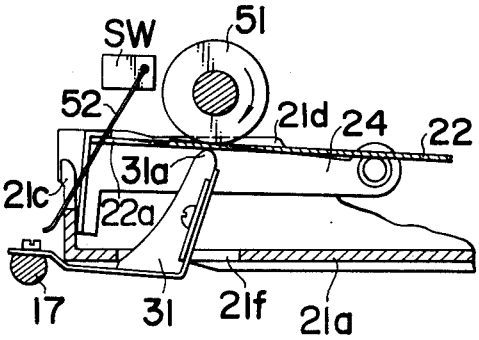
Figure 7C:
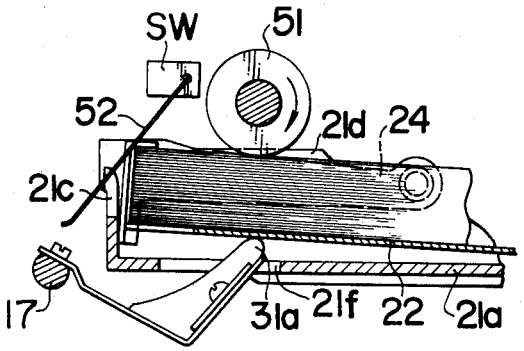

A rotary switch SW.A is fixedly mounted in the machine to the left and forwardly of the feed roller 51, and has its operating axle connected with a forwardly and downwardly extending rod-shaped actuating arm 52, which is urged by a spring (not shown) to rotate in the CCW direction about the operating axle of the switch. The arm 52 extends through the notches 22*a*, 21*c* formed in the sheet receiving plate 22 and the front wall 21*b* of the cassette, so that the resilient bias applied to the arm 52 causes it to rotate in the CCW direction so as to have its free end bearing against the lower edge of the notch 21*c* to close the switch SW.A when the cassette receiving plate 22 lies flat against the bottom of the cassette (FIG. 7*a*) or when no sheet is present on the plate 22 (FIG. 7*b*). On the other hand, when the plate 22 is raised carrying sheets thereon (FIG. 7*c*), the arm 52 is in sliding contact with the forward edges of the sheets to have its free end raised, rotating in the CW direction to cause the switch SW.A to open the circuit. In this manner, it is possible to determine the presence or absence of any sheet contained in the cassette by the circuit condition of the switch when the plate 22 is raised.

Corresponding counterpart components are arranged in association with the lower case 12 in the same manner as mentioned above in connection with the upper case 11, and operate in the same manner, so that they will not be described repeatedly, noting that they are designated by like reference characters with one hundred added. The rotary switch associated with the lower case, which corresponds to the rotary switch SW.A, is designated by SW.B.

Figure 6A:
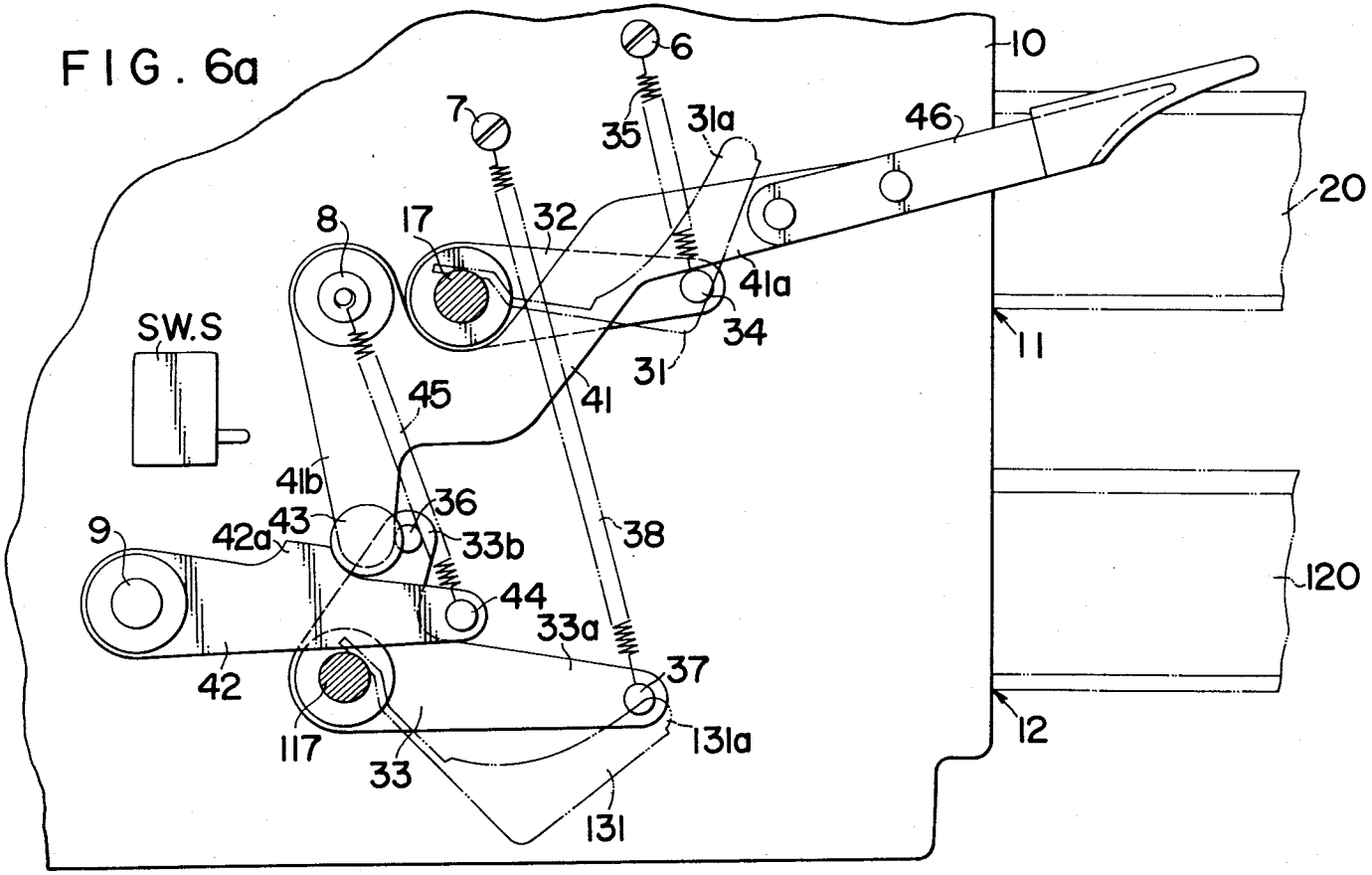
FIGS. 6*a* and 6*b* are side elevations of pushers and switching members in their upper and lower case selecting positions, respectively.
Figure 6B:
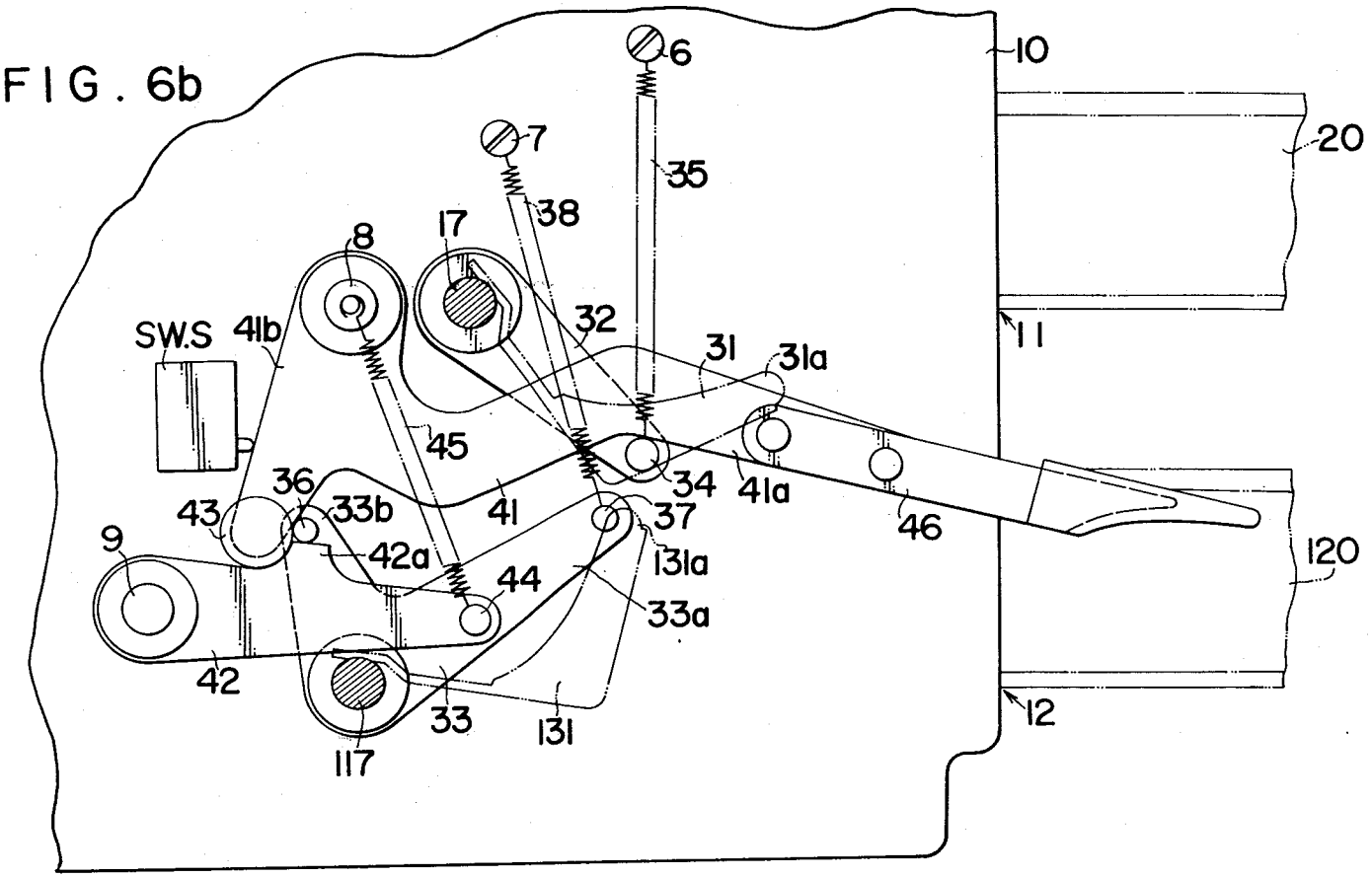

With reference to FIG. 6*a*, a mechanism for rotating the actuating arms 31, 131 of the pushers when a particular cassette is to be selected will be described. FIG. 6*a* shows the position of various parts when the upper case is to be selected. A rocker arm 32 has its one end secured to one end of the rotary shaft 17 on which the arm 31 is mounted, and its rearwardly extending free end fixedly carries a pin 34 which is engaged by one end of a tension spring 35, the other end of which engages a stationary stud 6, thereby urging the actuating arm 31 to rotate in the CCW direction. However, such rotation is normally prevented by abutment of the pin 34 against the lower edge of one arm 41*a* of an actuator rod 41 of a switching member to be described shortly. Similarly, a V-shaped rocker member 33 is secured at its apex to one end of the rotary shaft 117 on which the arm 131 is mounted, and its rearwardly extending free end fixedly carries a pin 37, which is engaged by one end of a tension spring 38, the other end of which engages a stationary stud 7, thereby urging the actuating arm 131 to rotate in the CCW direction. However, this rotation is also prevented by a pin 36 fixedly mounted on the end of the other upwardly extending arm 33*b* of the rocker member 33 which normally abuts against the rear edge of another arm 41*b* of the actuator rod 41.

The actuator rod 41 of the switching member is in the form of a shallow V, and is rotatably mounted at its apex on a fixed shaft 8 which extends horizontally at a position immediately in front of the rotary shaft 17 for the pusher associated with the upper case. It has a long arm 41*a* extending rearwardly and upwardly and which has a selection handle 46 mounted on its end. The handle 46 extends in a direction along the arm 41*a* to the exterior of the duplicating machine. The short arm 41*b* of the rod 41 fixedly carries a pin 43 on its free end.

Another fixed shaft 9 extends horizontally at a position forwardly of the rotary shaft 117 for the pusher associated with the lower case, and rotatably carries a rearwardly extending arm 42 of the switching member. A pin 44 is fixedly mounted on the free end of the arm 42, and is engaged by one end of a tension spring 45, the other end of which engages the upper fixed shaft 8, thus urging the arm 42 to rotate in the CCW direction. However, such rotation is prevented by the abutment of its upper edge 42*a* against the pin 43 on the actuator rod 41. The edge 42*a* is profiled in the form of a plateau so that the pin 43 engages the rear lobe of this edge while the actuator rod 41 is raised to select the upper cassette 20 while it engages the forward lobe of the edge 42 when the actuator rod 41 is lowered to select the lower cassette 120 (FIG. 6*b*), thus maintaining the actuator rod 41 in a selected position by clicking motion.

Summarizing the operation of various members and elements mentioned above, when the handle 46 is raised, the resilient bias on the actuator arm 31 of the upper case causes its tip 31*a* to rise, while the tip 131*a* of the actuator arm 131 of the lower case is maintained in its lower position. Conversely, when the handle 46 is lowered, the actuator arm 31 of the upper case is constrained, while the actuator arm 131 of the lower case is released. Since the tip of the constrained actuator arm is retracted below the associated case, a non-selected cassette can be freely removed from or inserted into the machine without requiring any additional detent or release operation.

Figure 8:
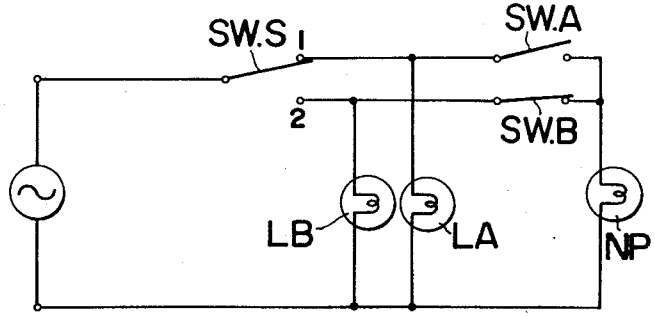
FIG. 8 is a circuit diagram of indicator lamps.

A two way switch SW.S is fixedly mounted at a position close to and forwardly of the lower arm 41*b* of the actuator rod 41, and operates to close a first circuit when the free end of the arm 41*b* is retracted and to close a second circuit when it has advanced. Lamps LA, LB and NP indicating "upper case feed," "lower case feed" and "cassette empty," respectively, are suitably disposed on the exterior of the duplicating machine. These switches and lamps constitute together a circuit shown in FIG. 8 so that a particular feed indicator lamp is energized depending on the operation of the handle 46. Illumination of cassette empty indicator lamp NP indicates the end of a cassette feeding operation from the selected cassette. It will be noted that the particular cassette that is in a feeding operation can also be recognized by noting the position of the handle 46 which is moved to a position adjacent to a selected cassette.

An operation of the duplicating machine having the cassette selection machine mentioned above will be described assuming that the cassette 20 contains sheets of B4 size and the cassette 120 contains sheets of B5 size and also assuming that a duplicating operation is initially desired for an original of B4 size and then switched to an original of B5 size. Initially, the handle 46 is lowered in order to load the cassette 20 into the upper case 11, and then the handle 46 is raised in order to load the cassette 120 into the lower case 12. In the course of such loading operation, the pusher arm associated with the non-selected case is moved out of the path of a corresponding cassette, so that a free insertion of the cassette into the selected case is assured. An original of B4 size is placed on an original receptacle of the machine, which is then set in operation. Since the handle 46 is now in a position to select the upper case, sheets of B4 size are fed by the feed roller 51 into the machine sheet by sheet, beginning with the uppermost sheet in the stack of the cassette 20. When an original of size B5 is substituted for the initial original, it is only necessary that the handle 46 be lowered. Then the handle 46 is firmly clicked into position, whereupon the upper roller 51 is out of engagement with the sheets in the upper cassette while the feed roller 151 of the lower case engages the sheets in the lower cassette 120, feeding sheets of B5 size. If cassette empty lamp NP is illuminated in operation, it is only necessary that the handle 46 be moved to the opposite position momentarily in order to withdraw the empty cassette and to replenish required sheets therein. It will be noted that an operation of the handle 46 is all that is required during the machine operation.

While in the above description, the use of B4 and B5 sizes are illustrated, it should be understood that the combination of sizes of sheets in the both cassettes may be arbitrarily chosen. If it is desired to use another size, for example, A4 size, the only necessary change is to replace the partition 27 by one having corner separators adapted to A4 size. It should be obvious that the length of the cassette may be arbitrarily chosen since its length has no influence upon the cassette loading. Additionally it will be appreciated that any desired number of cases be provided within the machine so as to receive a plurality of cassettes containing sheets of different respective sizes, thereby permitting an immediate change of sheet size by a simple operation of the handle. No unlocking of the cassette is required during removal. The selected cassette can be readily recognized by the indicator lamp or by noting the position or the size, preventing a mismatch of sheet size. A variety of sizes of sheets can be used with a reduced number of cassettes.

What is claimed is:

1. An apparatus for selectively feeding sheets from a plurality of cassettes each containing sheets of different respective sizes, with each cassette having therein a sheet receiving plate, for receiving a stack of sheets thereon, movable upwardly within the respective cassette, and with each cassette having an opening formed in its bottom wall for access to the sheet receiving plate from the exterior of the cassette, said apparatus comprising, in combination, support means operable to receive and support plural said cassettes one by one in a vertical array; respective feeding means operatively associated with each casette received in said support means for feeding sheets from a stack thereof loaded in the associated cassettes on the receiving plate thereof; all of said feeding means being activated simultaneously and deactivated simultaneously; respective pushing means operatively associated with each cassette received in said support means and movable between an operative position, in which the pushing means extends through such bottom opening of the associated cassette to engage the receiving plate thereof and lift the receiving plate to bring the stack of sheets thereon into operative relation with the associated feeding means, and a retracted position, in which the pushing means is disengaged from the associated cassette and the receiving plate thereof whereby, in the retracted position of each pushing means, the associated cassette may be withdrawn from and inserted into said support means; a single manual means movable selectively to plural preset positions equal in number to the number of cassettes received in said support means with each position corresponding to a selected cassette; and mechanical means mechanically connecting said single manual means to all of said pusher means and normally restraining said pusher means in their retracted positions; said mechanical means, responsive to movement of said single manual means to a selected one of said preset positions, moving the pusher means of the corresponding cassette to its operative position for effecting feeding of sheets from such corresponding cassette.

2. An apparatus according to claim 1 in which the feeding means comprise feed rollers each located at a given position relative to the respective loaded cassette.

3. An apparatus according to claim 1 in which the manual means comprise a lever having a handle.

4. An apparatus according to claim 3, in which said lever is positioned adjacent the array of cassettes for movement into respective positions each adjacent a selected cassette; said lever, when moved to a respective position, moving, through said mechanical means, the pushing means associated with the selected cassette to its operative position; whereby the position of said lever handle serves as an indication of the selected cassette.

5. An apparatus according to claim 1, further including means detecting an exhaustion of sheets in a previously loaded cassette, and means indicating such detection.

6. An apparatus according to claim 5, in which said indicating means is operable only responsive to exhaustion of sheets in that cassette associated with the particular pushing means then rendered operative by movement of said manual means to the associated one of said plural preset positions.

7. An apparatus according to claim 1 in which at least one cassette includes a partition for positioning a stack of sheets of different sizes on its receiving plate.

8. An apparatus according to claim 1, in which each respective pushing means comprises a lever pivotally mounted at its one end; respective spring means biasing each lever toward its operative position; said mechanical means maintaining each lever in its retracted position, in which it is retracted outwardly from such bottom opening of the associated cassette, against the biasing of the associated spring means, until the manual means is operated to effect movement of a selected lever to its operative position.

* * * * *